US008075322B2

(12) United States Patent
Schwettmann et al.

(10) Patent No.: US 8,075,322 B2
(45) Date of Patent: Dec. 13, 2011

(54) CONNECTING ELEMENT FOR ELECTRIC CONDUCTORS WITH A PRINTED CIRCUIT BOARD

(75) Inventors: Hartmut Schwettmann, Rahden (DE); Andreas Nass, Warmsen (DE); Stefan Schnieder, Bohmte (DE)

(73) Assignee: Harting Electric GmbH & Co. KG (DE)

( * ) Notice: Subject to any disclaimer, the term of this patent is extended or adjusted under 35 U.S.C. 154(b) by 0 days.

(21) Appl. No.: 12/763,999

(22) Filed: Apr. 20, 2010

(65) Prior Publication Data

US 2010/0279523 A1 Nov. 4, 2010

(30) Foreign Application Priority Data

Apr. 29, 2009 (DE) ..... 20 2009 006 254 U

(51) Int. Cl.
*H01R 12/00* (2006.01)

(52) U.S. Cl. ..... 439/82; 439/78

(58) Field of Classification Search ..... 439/81–84
See application file for complete search history.

(56) References Cited

U.S. PATENT DOCUMENTS

| | | | | |
|---|---|---|---|---|
| 5,374,204 | A * | 12/1994 | Foley et al. | 439/751 |
| 5,664,973 | A * | 9/1997 | Emmert et al. | 439/862 |
| 6,089,880 | A * | 7/2000 | Miyagawa et al. | 439/82 |
| 7,270,575 | B2 * | 9/2007 | Krantz et al. | 439/620.15 |
| 7,290,344 | B2 | 11/2007 | Brandl et al. | 33/1 |
| 2003/0045139 | A1 * | 3/2003 | Hanson | 439/82 |
| 2003/0124886 | A1 * | 7/2003 | Reisdorf et al. | 439/82 |
| 2006/0110955 | A1 * | 5/2006 | Blossfeld | 439/82 |

FOREIGN PATENT DOCUMENTS

| | | |
|---|---|---|
| DE | 197 49 890 | 5/1999 |
| DE | 10 2004 020 422 | 11/2005 |

* cited by examiner

*Primary Examiner* — Hien Vu
(74) *Attorney, Agent, or Firm* — Hayes Soloway P.C.

(57) ABSTRACT

In order to separably connect an electric conductor (16) to a printed circuit board (2), it is proposed to insert a connecting element (1) into an opening (3) in the printed circuit board (2). In this case, a sleeve-like contact region (21) of the connecting element (1) is clamped against the inner surface (4) of the opening (3) by means of a clamping pin (7).

9 Claims, 10 Drawing Sheets

CONNECTING ELEMENT FOR ELECTRIC CONDUCTORS WITH A PRINTED CIRCUIT BOARD

BACKGROUND OF THE INVENTION

1. Field of the Invention

The invention pertains to an electric connecting element consisting of an is electric contact, a housing and a clamping pin for separably mounting an electric conductor on an opening of a printed circuit board.

2. Description of the Related Art

Connecting elements of this type are required for contacting an electric conductor at any location on a printed circuit board. In this case, optimal electric contacting between the printed circuit board and the connecting element needs to be ensured by means of a flawless mechanical seat of the connecting element on the printed circuit board.

U.S. Pat. No. 7,290,344 B2 discloses a method for connecting an electric conductor to a metal plate, wherein a cable lug radially expands a sleeve in a hole in the metal due to a screwed connection and thusly produces an electric connection.

DE 197 49 890 C1 discloses an electronic contact element that is provided with a central bore and axial slots on the mounting end, wherein elastic tabs are formed and these tabs are pressed radially outward when pressing in a pressure piece.

DE 10 2004 020 422 A1 discloses a pin for producing a solderless electric connection with a printed circuit board, with a press-fit region that can be elastically and plastically deformed in a hole of the printed circuit board in order to be adapted to the hole diameter. A press-fit tool that guides and reinforces the pin is provided for the insertion of the pin.

Permanent connections between a connecting element and a printed circuit board such as, for example, riveted connections are frequently utilized. In variations that utilize screwed or soldered connections for separably connecting a connecting element to printed circuit boards, a special tool is required for mounting and also for dismounting the element. The dismounted connecting element frequently cannot be reused due to a destructive dismounting.

SUMMARY OF THE INVENTION

The invention therefore is based on the objective of designing a connecting element in such a way that reliable contacting of an electric conductor on a printed circuit board is ensured without the aid of tools by means of an electric contact. It should furthermore be possible to dismount the connecting element from the printed circuit board in a non-destructive fashion in order to exchange and to reuse the connecting element and the printed circuit board.

This objective is attained in that the electric contact features a sleeve-like contact region that can be inserted into an opening in the printed circuit board and radially clamped against the inner surface of the opening by inserting a clamping pin into the sleeve-like contact region, and in that the electric contact features a terminal region with a termination for mounting the electric conductor.

The invention concerns an electric connecting element consisting of an electric contact, a housing and a clamping pin. The electric contact features a contact region and a terminal region. Contacting on a printed circuit board is realized by inserting the contact region into an opening in the printed circuit board, wherein at least the inner surface of the opening is provided with an electric contact area. The electric contact area preferably is circumferentially arranged on the opening in an L-shaped fashion such that electric contacting on the printed circuit board can also be realized around the opening.

In the contact region, the electric contact of the connecting element is realized in the form of a sleeve-like part with a bulgy distention and features at least one axial slot. The diameter of this sleeve-like contact region is elastically reduced in the axial direction during the insertion into an opening, wherein said contact region approximately reassumes its original shape once it is correctly seated. The clamping pin is inserted into the contact region in this state such that the contact region is clamped against the inner surface of the opening. A control of the electric contacting is not necessary because the clamping pin can only be inserted into the contact if the contact is correctly seated in the opening. Consequently, optimal seating and reliable contacting of the connecting element on the printed circuit board can be ensured.

In order to dismount the connecting element, it is merely required to pull the clamping pin out of the contact region or to press out the clamping pin from the opposite side. The contact can then be removed from the opening and from the printed circuit board.

The purely elastic deformations of the contact region during the mounting and dismounting on/from the printed circuit board make it possible to exchange the connecting element and/or to reuse the connecting element in another opening.

The dismounting therefore does not influence the mechanical seat of the connecting element when it is reused on another printed circuit board.

In one advantageous additional development of the clamping pin, a screwlike section is formed on the outer surface of said clamping pin. This serves for screwing the clamping pin out of the contact region with the aid of a screwdriver. However, the pin is still mounted by simply being pressed into the contact region.

A termination that is situated in the terminal region of the electric contact and serves for connecting an electric conductor may be realized in different ways. Aside from a simple surface or eye for soldering on the electric conductor, it is advantageous to realize the termination in the terminal region such that it is suitable for crimping. An electric conductor can be solidly connected to the is electric contact on this termination with a normal crimping tool.

Advantageous options for manufacturing the electric contact consist of fabricating the electric contact by means of a deep drawing method or in the form of a punched and rolled part.

It is proposed to encase the contact with an electrically non-conductive housing in the terminal region for insulating purposes. This housing features a recess, through which the clamping pin can be inserted into the contact region. One preferred embodiment consists of extrusion-coating the terminal region including the contacting end of the electric conductor. It would also be conceivable to pot the terminal region or to realize a variation that consists of two individual parts that can be joined.

In order to reliably transmit currents with up to 40 A, another practical measure consists of enlarging the contact area between the electric contact and the printed circuit board. For this purpose, the electric contact is provided with a support surface in the contact region, wherein this support surface is flatly seated on the contact area on the printed circuit board. The support surface features radially oriented, raised strip contacts that are distributed over the circular ring and contact on the printed circuit board. This is especially practical if the connecting element is mounted on other contact plates or sheets, the entire surface of which is metallic for contacting purposes.

In another preferred embodiment, the terminal region of the electric contact is also realized in a sleeve-like fashion, however, with a larger diameter than that of the contact region being inserted into the opening in the printed circuit board. The inner side of the terminal region features a constriction and a disk-shaped section formed on the clamping pin engages behind said constriction. A second disk-shaped section formed on the head of the clamping pin is provided for allowing a simple removal of the clamping pin.

It is furthermore proposed to mount connecting elements on a printed circuit board in a positioning frame. This positioning frame may be realized in such a way that several connecting elements can be simultaneously accommodated. Encoding pins provided on the positioning frame prevent mismating of the mounting direction.

The advantages attained with the invention can be seen, in particular, in that reliable contacting is ensured with the connecting element, and in that the mounting can be realized without the utilization of tools and, if so required, even with one hand only. In addition, the connecting element and all components used can be easily and quickly dismounted, exchanged and reused.

One preferred application consists of mounting the electric connecting element with an already prepared cable.

BRIEF DESCRIPTION OF THE DRAWINGS

Two exemplary embodiments of the invention are illustrated in the drawings and described in greater detail below in which.

DESCRIPTION OF THE PREFERRED EMBODIMENTS

Figure 1:
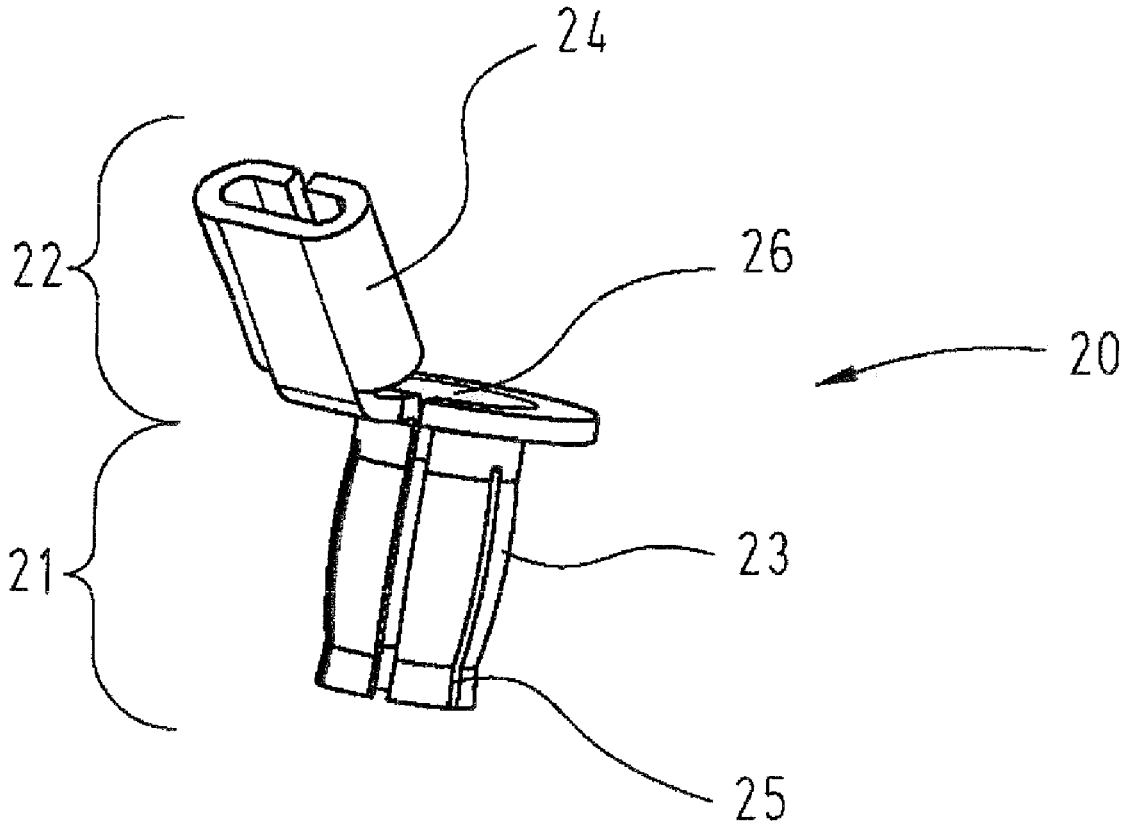
FIG. 1 is a detailed three-dimensional view of an electric contact.

FIG. 1 shows a detailed three-dimensional view of an electric contact 20 with a contact region 21 and a terminal region 22 that is realized in the form of a punched and rolled part.

This figure shows the sleeve-like contact region 21 that features a bulgy distention 23 in its center. Axial slots 25 extend from the end of the contact region 21 that is illustrated on the bottom in this figure to slightly beyond the end of the bulgy distention 23 that is illustrated on the top. After connecting an electric conductor 16, a termination 24 designed for crimping is provided with a housing 10 together with the terminal region 22 of the electric contact 20. A first opening 26 of the contact region 21 that is illustrated on the top in this figure is not covered by the housing 10 in order to insert a clamping pin 7 such that a second opening 11 is formed in the housing.

Figure 2A:
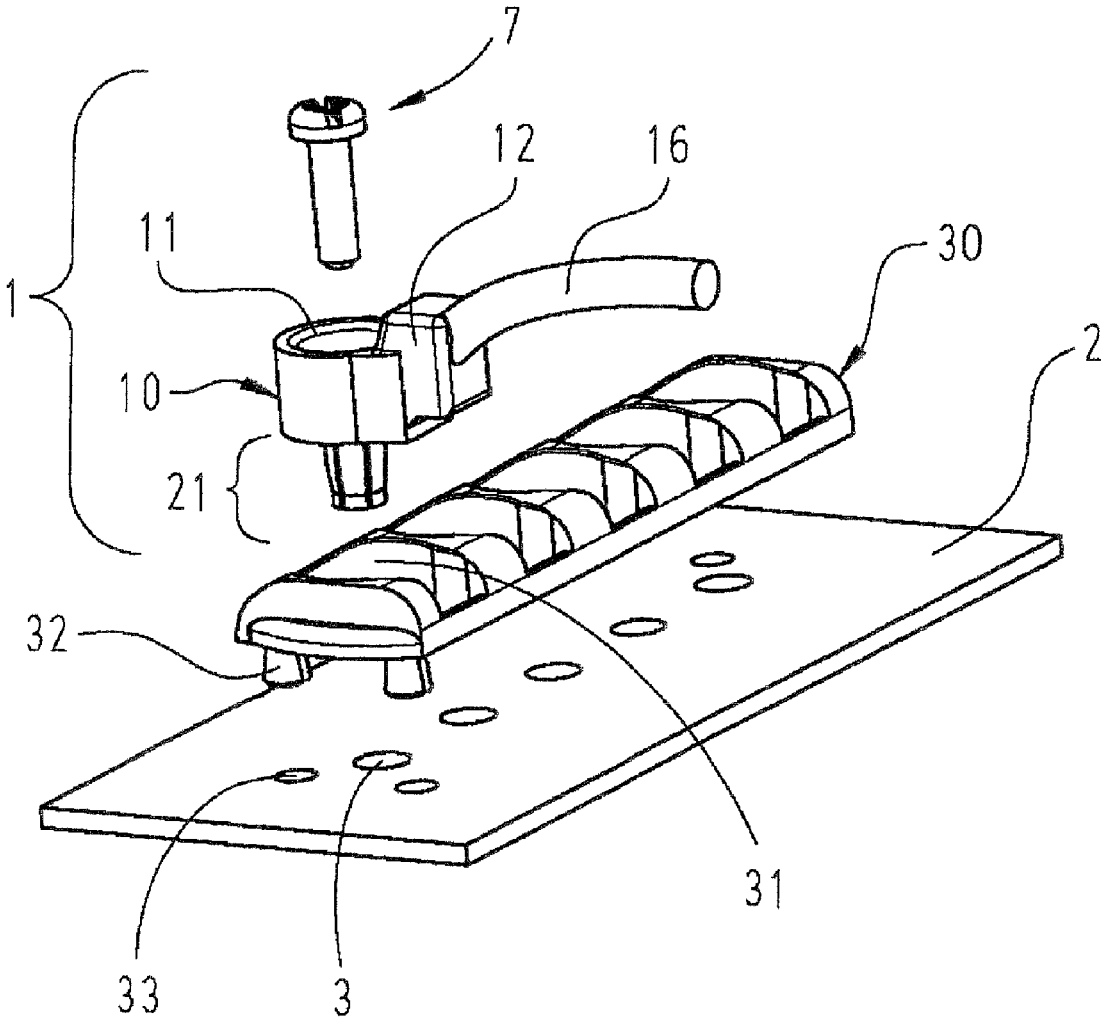
FIG. 2*a* is a one-part connecting element with an electric conductor prior to the mounting on a printed circuit board with a positioning frame.

FIG. 2*a* shows the electric contact 20 provided with a potted housing 10 prior to the mounting on a printed circuit board 2. In this embodiment, the connecting element 1 is additionally positioned on the printed circuit board 2 by means of a positioning frame 30. In the embodiment shown, this positioning frame 30 features five recesses 31 for the placement of five connecting elements 1. The contact region 21 of the electric contact 20 is inserted into an opening 3 in the printed circuit board 2. The clamping pin 7 is inserted through the opening 11 in the housing so as to clamp the electric contact 20 in the opening 3 and to produce an electrically conductive connection. A section 12 formed on the housing 10 accommodates the termination 24 and leads the electric conductor 16 away from the housing 10 and from the printed circuit board 2 at a desired angle. The positioning frame 30 furthermore features encoding pins 32 that only fit into receptacles 33 provided on the printed circuit board 2 in one position during the mounting thereon.

Figure 2B:
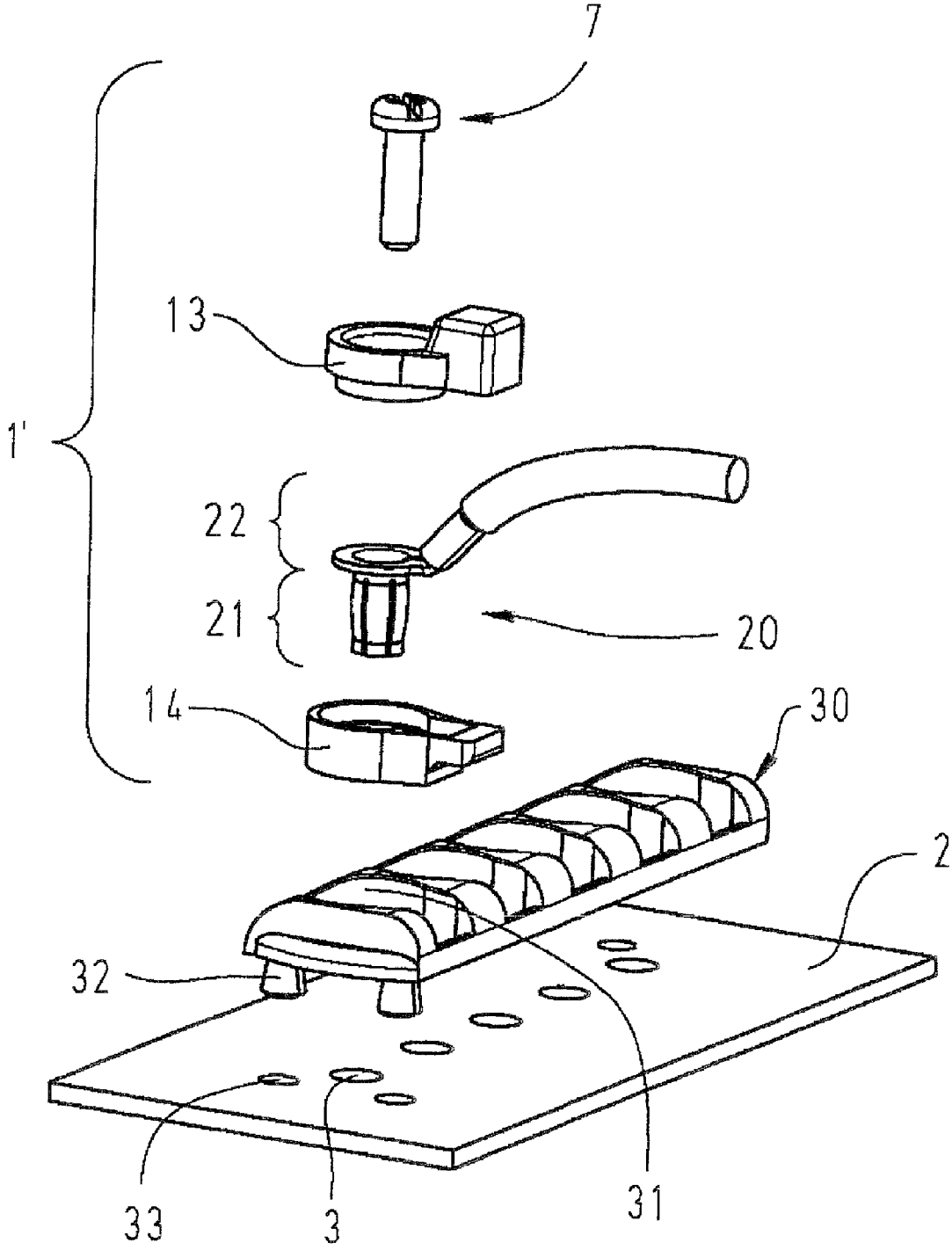
FIG. 2*b* is a multipart connecting element with an electric conductor prior to the mounting on a printed circuit board with a positioning frame.

FIG. 2*b* shows another embodiment of a connecting element 1' that is surrounded by a multipart housing 13, 14 rather than a potted housing.

The mounting is realized by initially inserting the electric contact 20 into the lower housing part 14 in this figure. Subsequently, the upper housing part 13 is attached to the first housing part such that the terminal region 22 of the electric contact 20 is completely encased by the housing.

The further mounting is carried out in accordance with FIG. 2*a*.

Figure 3A:
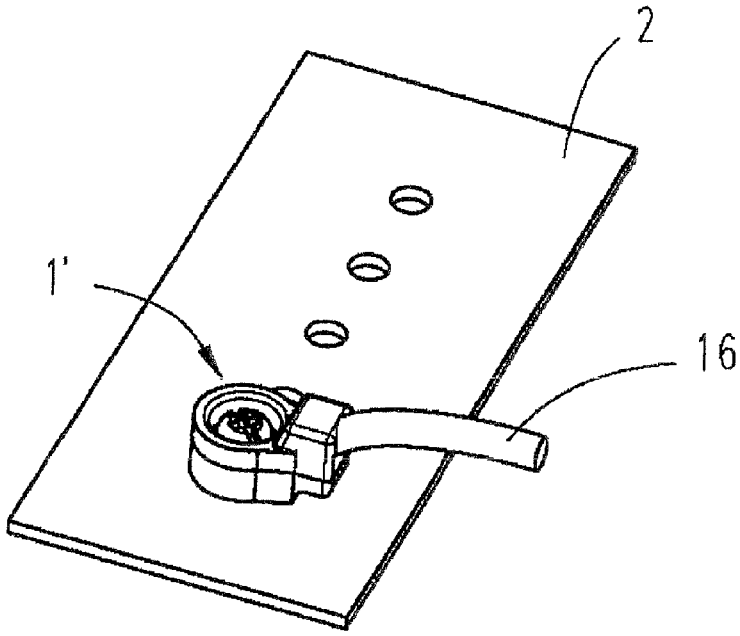
FIG. 3*a* is a multipart connecting element mounted on a printed circuit board.
Figure 3B:
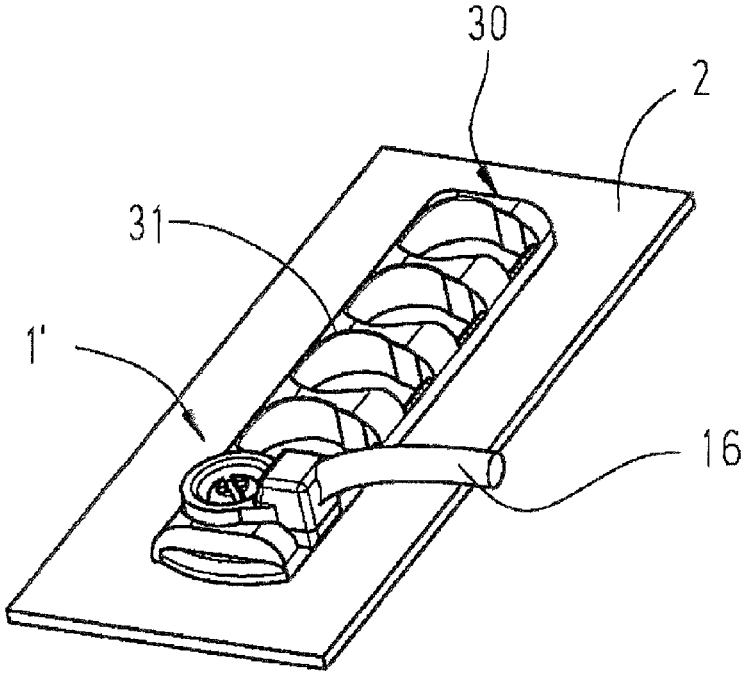
FIG. 3*b* is a multipart connecting element mounted on a printed circuit board in a positioning frame.

FIGS. 3*a* and 3*b* respectively show a connecting element 1' mounted on a printed circuit board 2.

In this case, FIG. 3*a* shows the individual connecting element 1' mounted on the printed circuit board 2 and FIG. 3*b* shows the connecting element 1' that is mounted on the printed circuit board 2 with the aid of the positioning frame 30.

Figure 4:
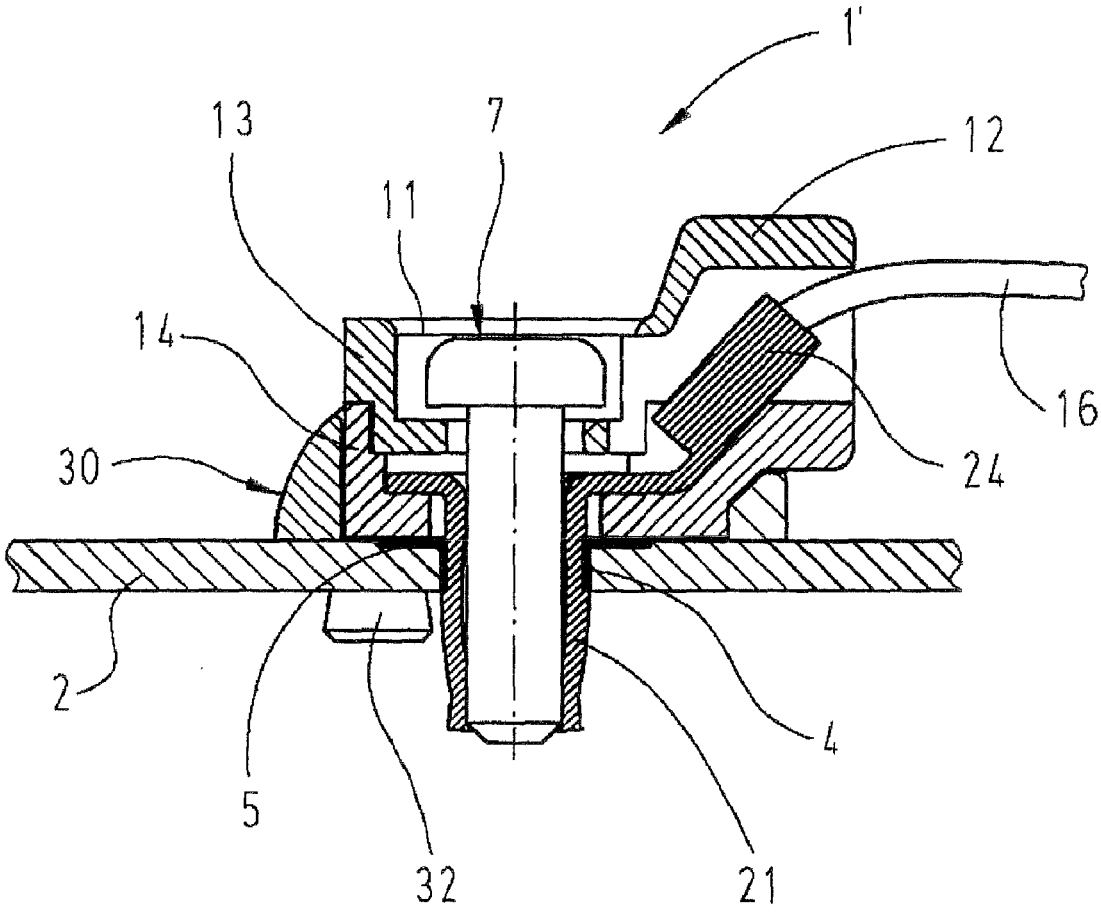
FIG. 4 is a sectional representation of a mounted connecting element with a multipart housing.

FIG. 4 shows a multipart connecting element 1' mounted on a printed circuit board 2 in the form of a cross section. This figure shows the clamping pin 7 that radially clamps the contact region 21 of the electric contact 20 against the inner surface 4 of the opening 3 from inside and thusly produces an electrically conductive connection. In this embodiment, the electric contact 20 is encased with a two-part housing 13, 14. The housing 13, 14 embedded by the positioning frame 30 is seated on the printed circuit board 2.

Figure 5A:
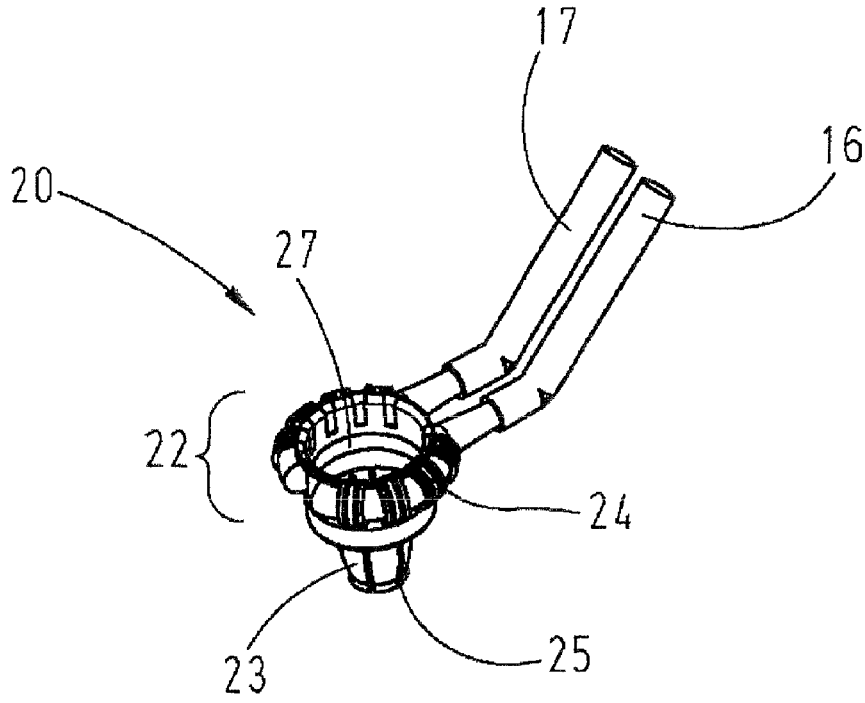
FIG. 5*a* is a three-dimensional representation of an electric contact with two electric conductors.
Figure 5B:
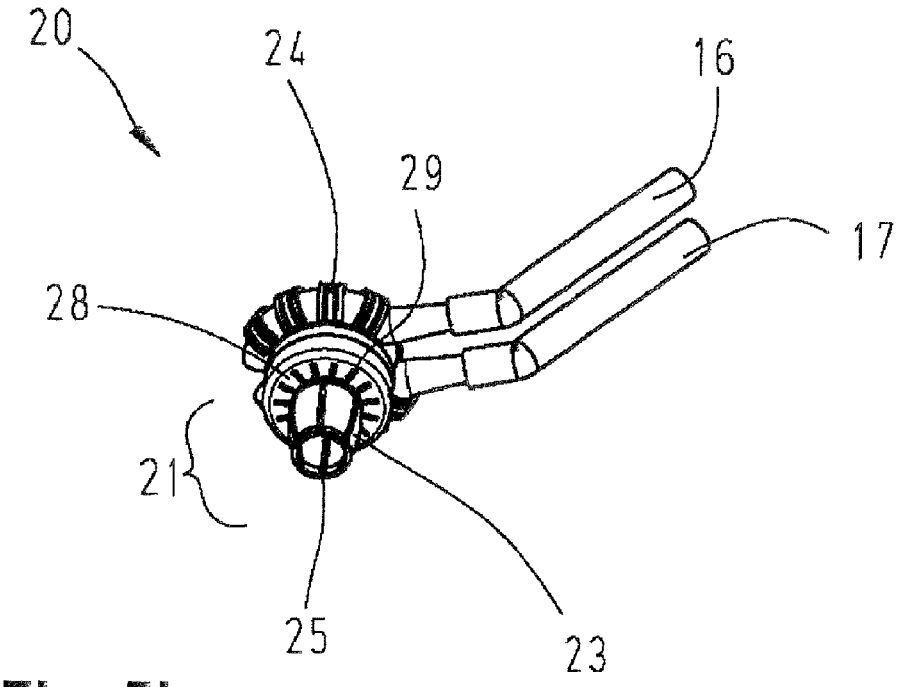
FIG. 5*b* is the electric contact according to FIG. 5 viewed from the contact side.

FIGS. 5*a* and 5*b* show a detailed three-dimensional view of an electric contact 20 manufactured by means of a deep drawing method from two directions. In this case, FIG. 5*a* shows the contact from the direction of the terminal region 22 and FIG. 5*b* shows the contact from the direction of the contact region 21.

This contact 20 is designed for contacting two electric conductors 16, 17.

This figure shows the contact region 21 that features a bulgy distention 23 in its center. The axial slots 25 extend from the end of the contact region 21 that is illustrated on the bottom in this figure to slightly beyond the end of the bulgy distention 23 that is illustrated on the top. In this embodiment, the terminal region 22 is also realized in a sleeve-like fashion and has a larger diameter than the contact region 21.

The circular surface 28 created at the diameter transition features radially oriented, raised strip contacts 29 that are distributed over the circular ring and serve as electric contact points for a seated contacting on the printed circuit board 2. Around the connecting region 22, the termination 24 is realized in the form of flexible contact arms that are bent around the two electric conductors 16, 17 shown in order to realize the electric contacting and to clamp the components together mechanically.

A circumferential constriction 27 is provided on the inner surface of the terminal region 22, wherein the inserted clamping pin 7 engages behind said constriction. It is proposed to encase the terminal region 22 with an externally potted housing 10 after the mounting of the electric conductors 16, 17.

Figure 6A:
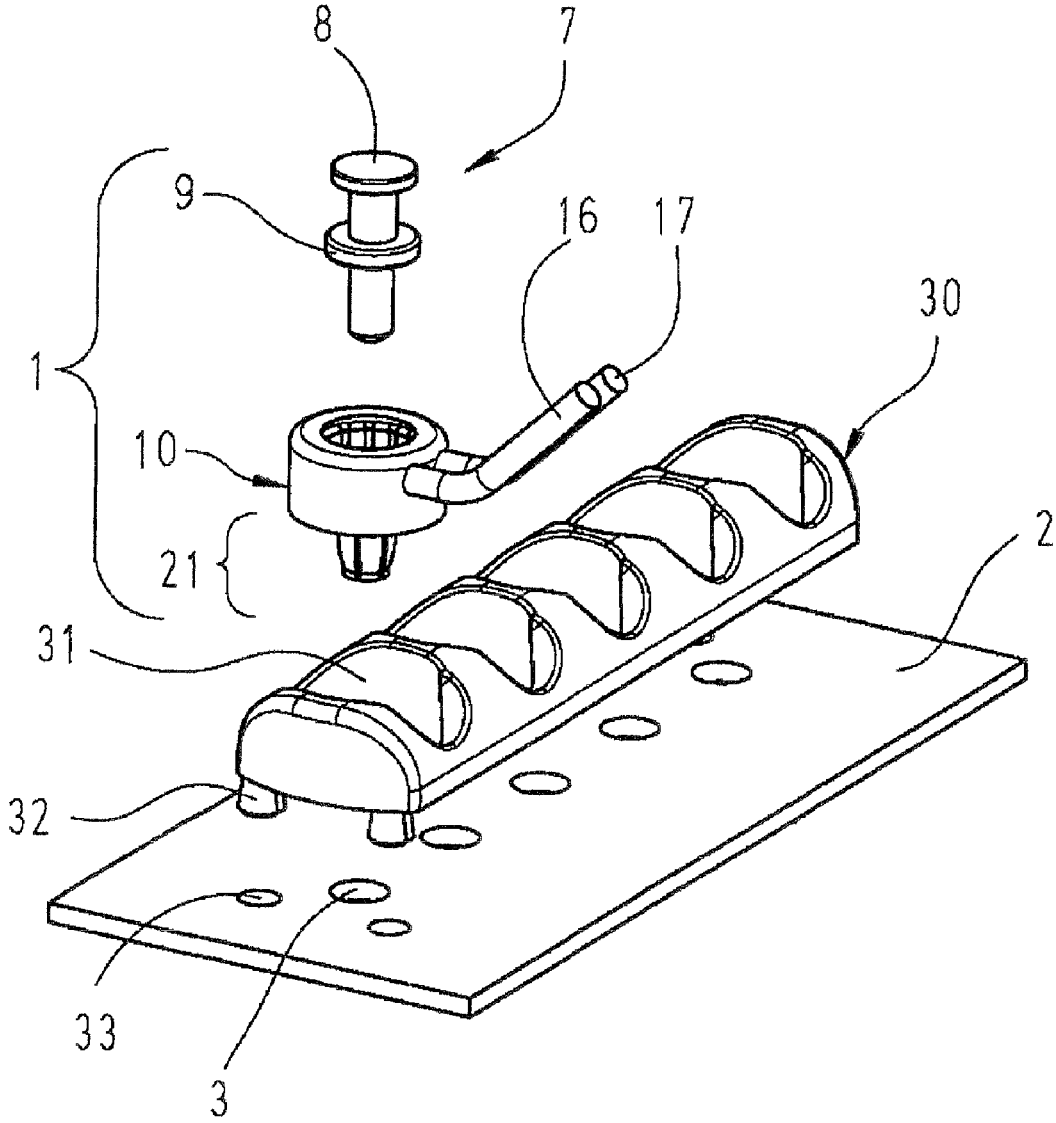
FIG. 6*a* is a one-part connecting element with two electric conductors prior to the mounting on a printed circuit board with a positioning frame.

FIG. 6*a* shows the electric contact 20 provided with a potted housing 10 prior to the mounting on a printed circuit board 2. In this embodiment, the connecting element 1 is additionally positioned on the printed circuit board 2 by means of a positioning frame 30.

In the embodiment shown, this positioning frame 30 features five recesses 31 for the placement of five connecting elements 1.

The contact region 21 of the electric contact 20 is inserted into an opening 3 in the printed circuit board 2. The clamping pin 7 is inserted into the terminal region 22 and the contact region 21 in order to clamp the electric contact 20 in the opening 3 and to thusly produce an electrically conductive connection. In this embodiment, two sections 8, 9 are formed on the clamping pin 7, wherein the central section 9 in this figure engages behind the circumferential constriction 27 in the interior of the terminal region 22 during the insertion into the electric contact 20. The section 8 illustrated on the top in this figure is provided for mounting and dismounting purposes. The positioning frame 30 furthermore features encoding pins 32 that only fit into receptacles (33) provided on the printed circuit board 2 in one position during the mounting thereon.

Figure 6B:
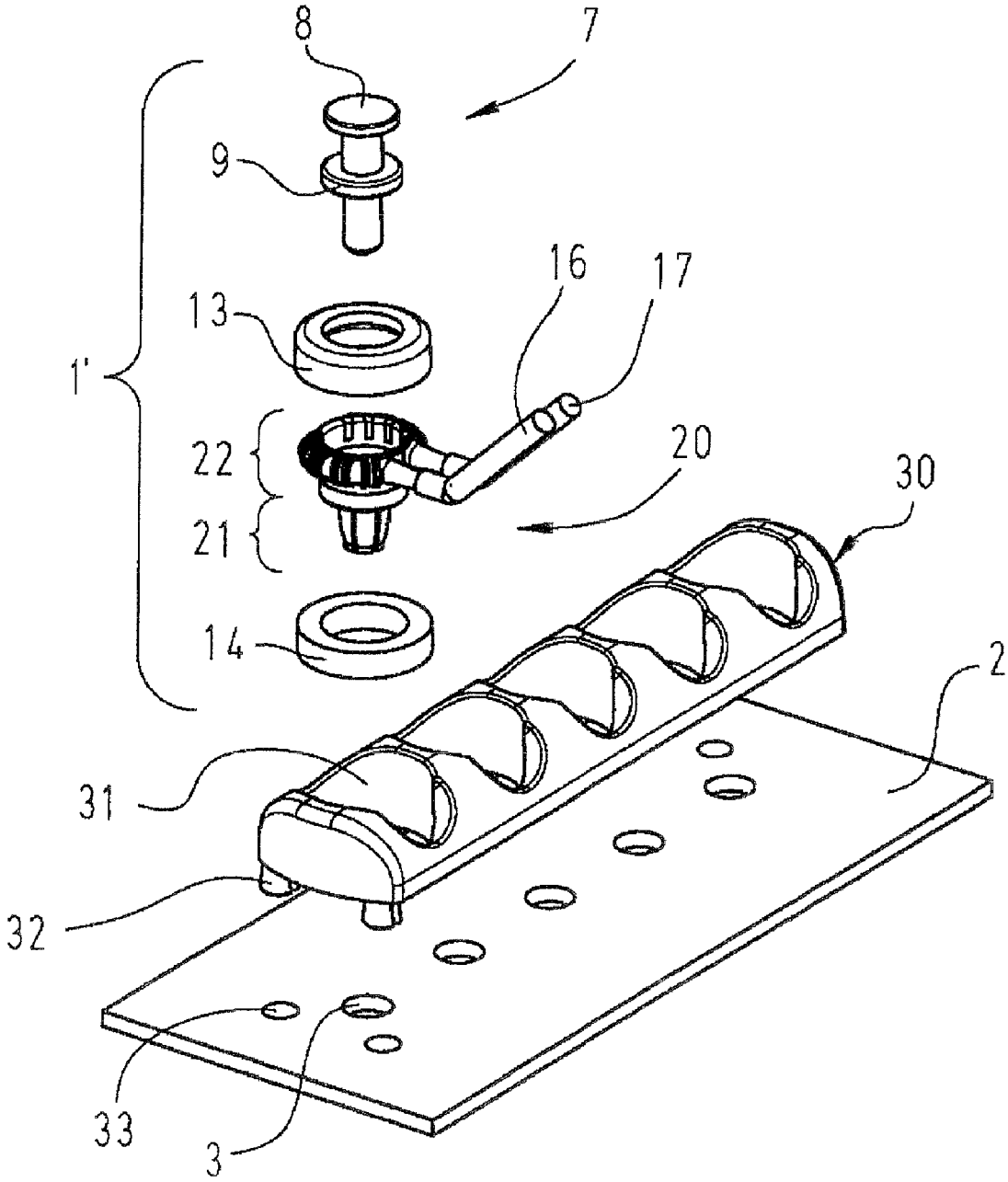
FIG. 6*b* is a multipart connecting element with two electric conductors prior to the mounting on a printed circuit board with a positioning frame.

FIG. 6*b* shows the multipart connecting element 1' that is surrounded by a multipart housing 13, 14 rather than a potted housing. The electric contact 20 is mounted by initially being inserted into the lower housing part 14 in this figure. Subsequently, the upper housing part 13 is attached to the first housing part such that the terminal region 22 of the electric contact 20 is completely encased by the housing.

The further mounting is carried out in accordance with FIG. 6*a*.

Figure 7A:
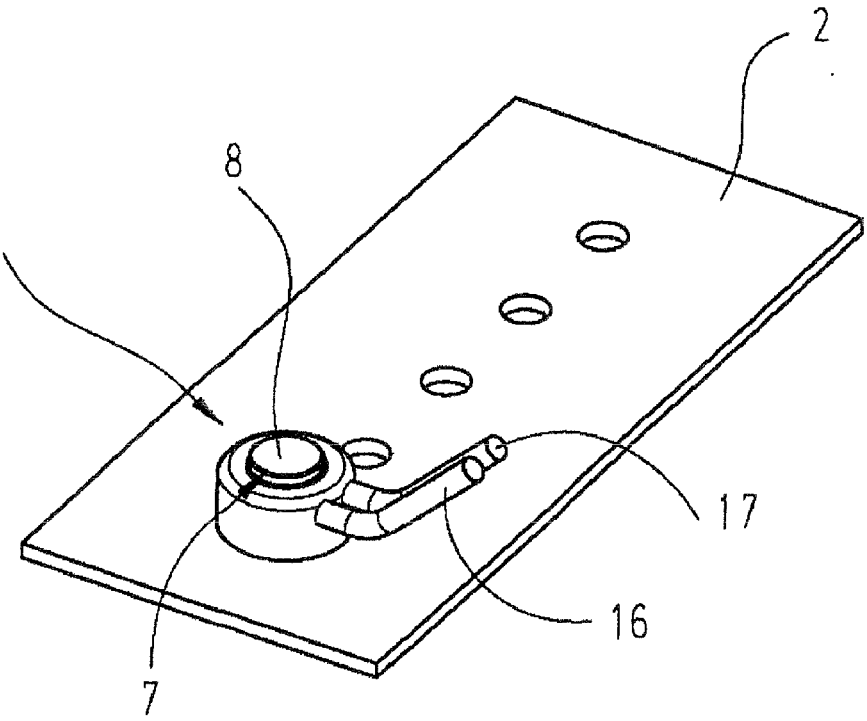
FIG. 7*a* is a connecting element according to FIG. 6*a* that is directly mounted on a printed circuit board.
Figure 7B:
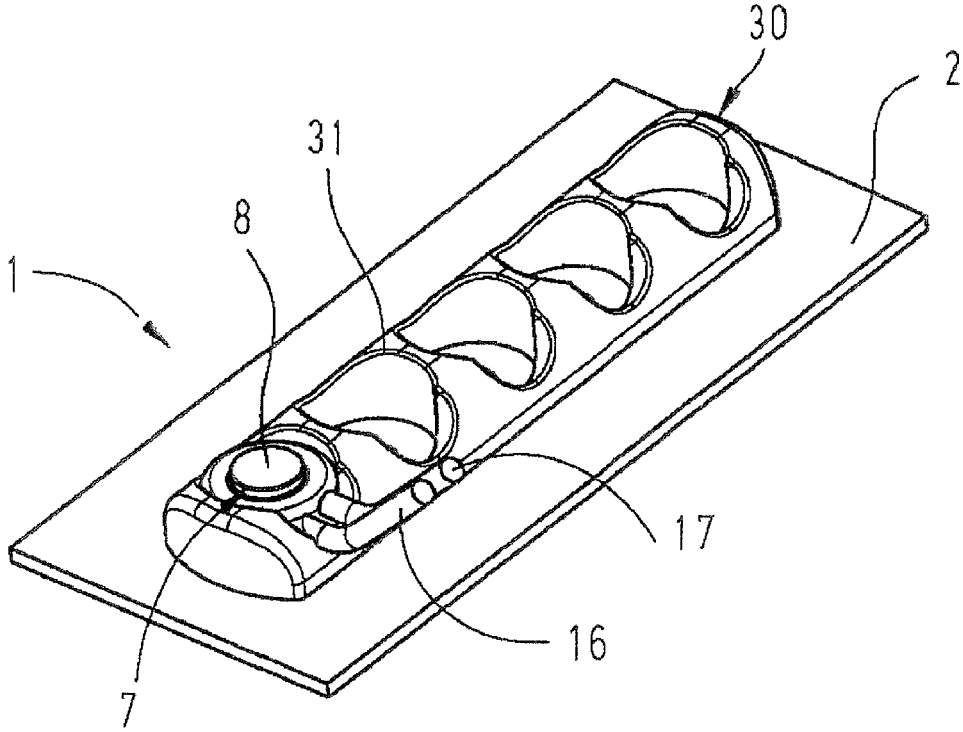
FIG. 7*b* is a connecting element according to FIG. 6*a* that is mounted on a printed circuit board in a positioning frame.

FIGS. 7*a* and 7*b* respectively show a connecting element 1 according to the second embodiment that is mounted on a printed circuit board 2.

FIG. 7*a* shows an individual connecting element (1) that is directly mounted on the printed circuit board 2. Only the section 8 formed on the inserted clamping pin 7 for dismounting purposes is visible of the clamping pin in this figure.

Figure 8:
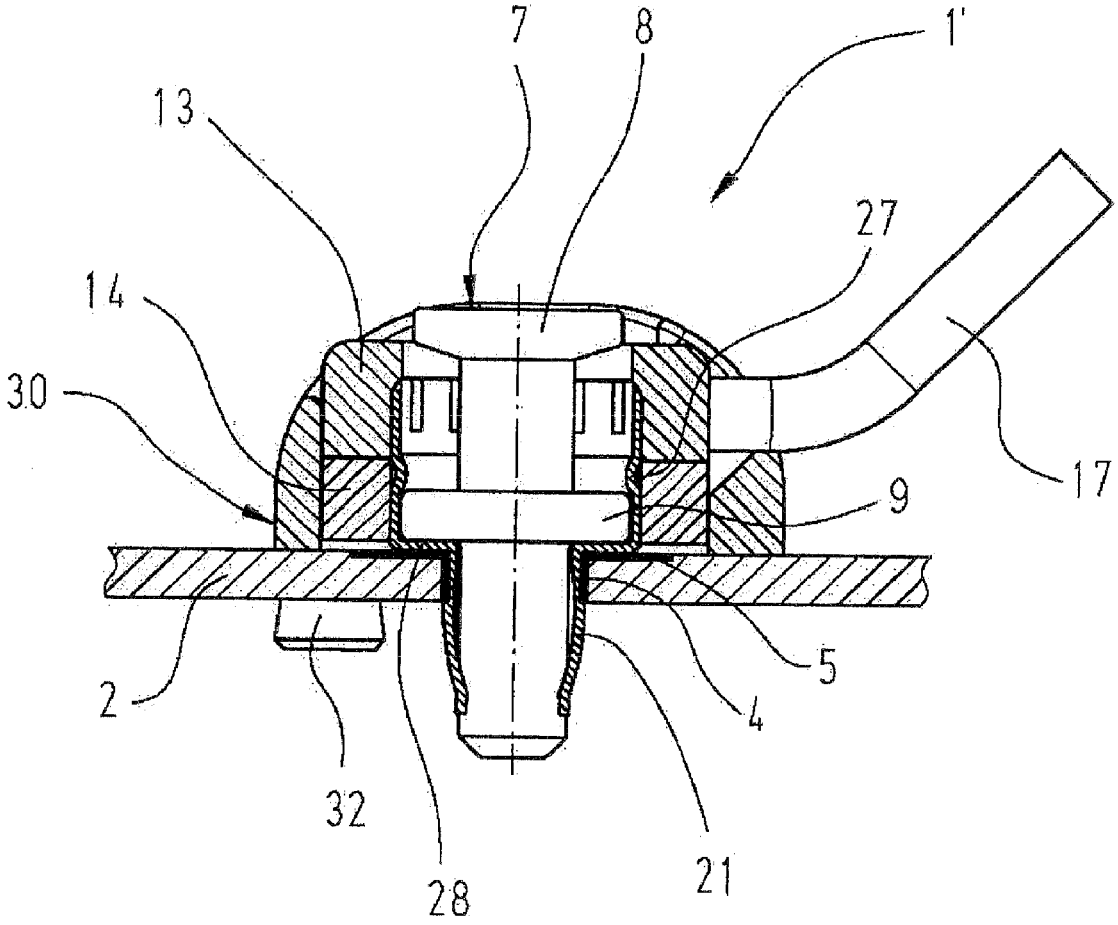
FIG. 8 is a sectional representation of a multipart connecting element mounted on a printed circuit board.

FIG. 8 shows a connecting element 1 mounted on a printed circuit board 2 in the form of a cross section. This figure shows the clamping pin 7 that radially clamps the contact region 21 of the electric contacts 20 against the inner surface 4 of the opening 3 from inside and thusly produces an electrically conductive connection. The central section 9 formed on the clamping pin 7 is engaged behind the circumferential constriction 27 in the terminal region 22. In this embodiment, the electric contact 20 is encased by two-part housing 13, 14 that is positioned in the positioning frame 30. The surface 28 of the electric contact 20 is seated on the contact region of the printed circuit board 2 in order to enlarge the electric contact area.

What is claimed is:

1. An electric connecting element comprising:

an electric contact;

a housing; and a clamping pin, wherein the electric contact includes a sleeve-like contact region for inserting into an opening in a printed circuit board, wherein the clamping pin is insertable into the housing and the electric contact, whereby when the clamping pin is inserted into the electric contact and the sleeve-like contact region is inserted into the opening in the printed circuit board, the clamping pin radially clamps the electric contact against an inner surface of the opening of the printed circuit board, and wherein the electric contact includes a terminal region extended outwardly therefrom having a termination for connecting at least one electric conductor of a wire.

2. The electric connecting element according to claim 1, wherein the contact region of the electric contact includes a radially bulging distention around the opening.

3. The electric connecting element according to claim 1, wherein the contact region of the electric contact includes at least one axial slot.

4. The electric connecting element according to claim 1, wherein the termination is designed in such a way that the electric conductor can be connected by clamping or soldering.

5. The electric connecting element according to claim 1, wherein the electric contact is manufactured in the form of a punched and rolled part, a deep-drawn part or a turned part.

6. The electric connecting element according to claim 1, wherein the housing encases the terminal region of the electric contact and the electric conductor, wherein the opening of the contact region remains recessed.

7. The electric connecting element according to claim 6, wherein the housing is composed of a lower part and an upper part.

8. The electric connecting element according to claim 6, wherein the housing is a one-part housing.

9. The electric connecting element according to claim 1, wherein the electric contact contacts a contact area on the printed circuit board that surrounds the opening.

* * * * *